US007061741B2

(12) United States Patent
Burke et al.

(10) Patent No.: US 7,061,741 B2
(45) Date of Patent: Jun. 13, 2006

(54) METHOD FOR MAGNETIC FIELD REDUCTION USING THE DECOUPLING EFFECTS OF MULTIPLE COIL SYSTEMS

(75) Inventors: Patrick Earl Burke, Toronto (CA); Richard Frederick Dudley, Toronto (CA); Barry R. McLean, Bond Head (CA); Michael Richard Sharp, Pickering (CA)

(73) Assignee: Trench Limited, Scarborough (CA)

( * ) Notice: Subject to any disclaimer, the term of this patent is extended or adjusted under 35 U.S.C. 154(b) by 373 days.

(21) Appl. No.: 10/389,107

(22) Filed: Mar. 14, 2003

(65) Prior Publication Data

US 2004/0179319 A1 Sep. 16, 2004

(51) Int. Cl.
*H01H 47/00* (2006.01)

(52) U.S. Cl. ..... 361/143

(58) Field of Classification Search ..... 361/143, 361/146; 336/181; 335/299
See application file for complete search history.

(56) References Cited

U.S. PATENT DOCUMENTS 3,333,162 A * 7/1967 Arbuthnot, III ..... 361/146
4,395,691 A * 7/1983 Knauer ..... 335/210
4,823,081 A * 4/1989 Geisler ..... 324/225
4,947,083 A * 8/1990 Bosch et al. ..... 315/8
5,016,600 A 5/1991 Hilal
5,028,850 A * 7/1991 Grote et al. ..... 315/371
5,331,282 A 7/1994 McDougall et al.
5,448,214 A 9/1995 Laskaris
5,463,364 A 10/1995 Muller
5,473,301 A 12/1995 Hall et al.
5,483,410 A * 1/1996 Holmes et al. ..... 361/149
5,661,399 A 8/1997 Sellers
5,717,333 A 2/1998 Frese et al.
6,163,240 A 12/2000 Zuk et al.
6,172,608 B1 * 1/2001 Cole ..... 340/572.1
6,208,135 B1 * 3/2001 Shattil ..... 324/225
6,633,217 B1 * 10/2003 Post ..... 335/306
2004/0228387 A1 * 11/2004 Palazoglu et al. ..... 374/163

* cited by examiner

*Primary Examiner*—Stephen W. Jackson
*Assistant Examiner*—Boris Benenson
(74) *Attorney, Agent, or Firm*—Stephen B. Salai, Esq.; Brian B. Shaw, Esq.; Harter, Secrest & Emery LLP

(57) ABSTRACT

A method for reducing the magnetic field level in the vicinity of two or more connected reactors wherein each reactor is a magnetic dipole and wound so that currents flow in opposite directions and resulting in magnetic fluxes opposing each other.

19 Claims, 4 Drawing Sheets

METHOD FOR MAGNETIC FIELD REDUCTION USING THE DECOUPLING EFFECTS OF MULTIPLE COIL SYSTEMS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING"

Not Applicable

FIELD OF INVENTION

The present invention relates to dry type air core system configuration, and more particularly to a method whereby a significant reduction in external magnetic field strength is achieved in a limited space.

BACKGROUND OF INVENTION

Although current research indicates that there are no biological risks associated with exposure to electromagnetic fields, the strategy of prudent avoidance is practical in terms of sitting exposure limits for the general public and even for workers in the electrical power sector. On this basis, exposure limits have been set for alternating power frequency magnetic fields. Air core reactors, like other power equipment (including transmission lines, etc.) are subject to these criteria.

Current practice to achieve compliance is based on the practice of increasing distance from the source. Essentially, exposure is limited by the use of barriers, actual or imposed, thereby controlling the area surrounding an energized dry type air core reactor. Actual barriers include security-fenced areas, whereas imposed barriers include the use of elevated support structures, which increase the distance between an energized dry type air core reactor and an individual at ground level. These approaches produce the desired result of limiting the strength of magnetic field to which an individual is exposed, at least in part. However, the drawback is an increase in real estate required for an installation. This has both economic consequences and land availability issues. In many urban settings electrical substation real estate is limited and increased "magnetic clearance" is therefore not a viable option. Therefore, another methodology for reducing the magnetic field strength in areas accessible by the general public and electrical power workers is required.

DESCRIPTION OF RELATED ART

Three-Phase Banks

Three-phase systems have been used for years to generate, transmit, control, and utilize electrical power. Besides its economic advantages it also reduces the external magnetic fields of transmission lines and reactor banks compared to single-phase systems.

Isolation

As stated previously, in the application of air core reactors, one of the techniques utilized to meet a set magnetic field limit was to use increased distance from the source. In other words, access to humans was limited by fencing or the use of tall mounting structures.

Toroidal Reactors

Air core reactors in small sizes can be built in toroidal form to produce a negligible external field. However, this construction is not suitable for large power reactors due to the problem of cooling and the extremely high cost associated with it.

Conductive Shielding

For smaller air core reactors the external field may be virtually eliminated by enclosing the reactor in a conducting enclosure, as illustrated in FIG. 1(*a*). The enclosure is such that induced currents may flow circumferentially about the reactor to produce a magnetic fields opposite that of the reactor. In addition, the enclosure must not be too close to the reactor because the currents in the enclosure will cause a reduction in the inductance of the unit and losses in the shield. This methodology is not practical for large power reactors because of the high cost associated with it.

Mangetic Shielding

The Westinghouse Electric Corporation has made available magnetically self-current shield current limiting reactors but maximum ratings were typically 0.025 ohms and 800 amperes. These methodologies are not practical for large power reactors because of the very high cost associated to it. In most cases, they were not suitable as outdoor units where the laminated steel yokes must be protected against the weather.

The field of an air core reactor may be shielded by using an array of vertical laminated steel yokes that gather much of the external magnetic flux and lower the ambient magnetic field considerably, as illustrated in FIGS. 1(*b*) and 1(*c*). The addition of short-circuited rings at both ends of the reactor creates an oppositely directed field, which further reduces the external field considerably. These two configurations are extensively used on water-cooled, induction heating reactors to prevent eddy-current heating of the steel supporting structure. This type of shielding is not applicable to air core power reactors, which are very much larger physically, of very much higher voltage ratings and, almost always, installed out of doors. The huge amount of laminated steel required and the need to protect it from the weather would make the cost prohibitive.

BRIEF SUMMARY OF THE INVENTION

It is an object of the present invention to overcome the above shortcomings.

It is a further object of the present invention to provide a method to achieve external magnetic field reduction.

It is yet a further object of the present invention to provide for multiple coils per phase to be employed and configured geometrically and electrically so as to virtually produce magnetic field cancellation.

At distances that are large compared to its diameter (roughly more than ten times) the magnetic field of a single reactor varies inversely as the cube of the distance from its center. At such distances it may be considered to be a dipole.

According to preferred embodiments of the invention, there is provided a method of configuring arrays of reactors to produce higher order multipoles so that the magnetic field of the array will vary inversely as distance to the fourth, and fifth and even higher powers.

According to a preferred embodiment of the invention, there is provided a method for controlling a magnetic field level that comprises the steps of connecting two reactors such that their dipole moments are opposed to form a quadrupole, the resulting far field of which varies inversely as the fourth power of the distance from the array; wherein the reactors' shapes, separation between said reactors and height above ground are chosen to meet a specified level of magnetic field at specified locations.

According to a further preferred embodiment of the invention, there is provided a method for controlling a magnetic field level that comprises the steps of connecting two quadrupole arrays, each of which is configured such that their quadrupole moments are opposed to form an octopole, the resulting far field of which varies inversely as the fifth power of the distance from the array; wherein the reactors' shapes, separation between said reactors and height above ground are chosen to meet a specified level of magnetic field at specified locations.

According to yet another preferred embodiment of the invention, there is provided a method for controlling a magnetic field level that comprises the steps of connecting $2^n$ reactors, where n is an integer, such that one half of them have dipole moments in the same direction and the other half have dipole moments in the opposite direction to form a multipole of order 2n, the far field of which varies with distance inversely as distance to the power (3+n); wherein the reactors' shapes, separation between said reactors and height above ground are chosen to meet a specified level of magnetic field at specified locations.

BRIEF DESCRIPTION OF THE SEVERAL VIEWS OF THE DRAWINGS

FIG. 1(*b*) is a cross-sectional view of a second prior art method of controlling a magnetic field;

FIG. 1(*c*) is a top plan view of the second prior art method of controlling a magnetic field;

FIGS. 2(*c*) and 2(*d*) are elevational views and accompanying plan views illustrating a preferred method of the present invention using four reactors;

DETAILED DESCRIPTION OF THE INVENTION

Figure 1A:
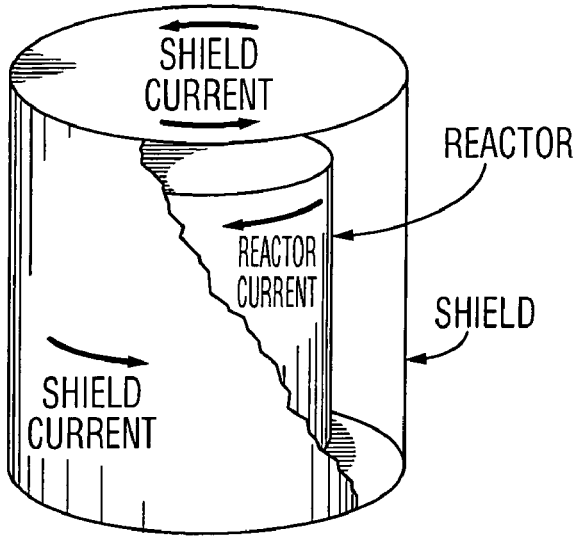
FIG. 1(a) (PRIOR ART)
FIG. 1(*a*) is a cross-sectional view of a first prior art method of controlling a magnetic field.
Figure 1B:
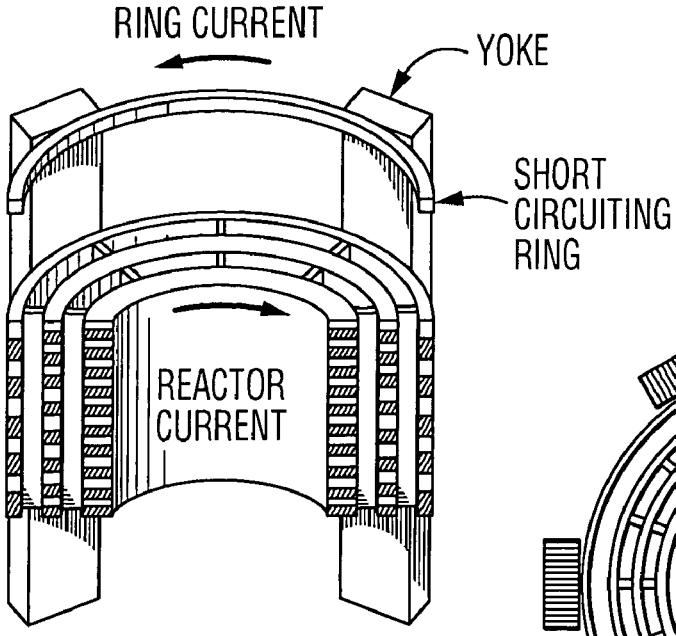
FIG. 1(b) (PRIOR ART)
Figure 1C:
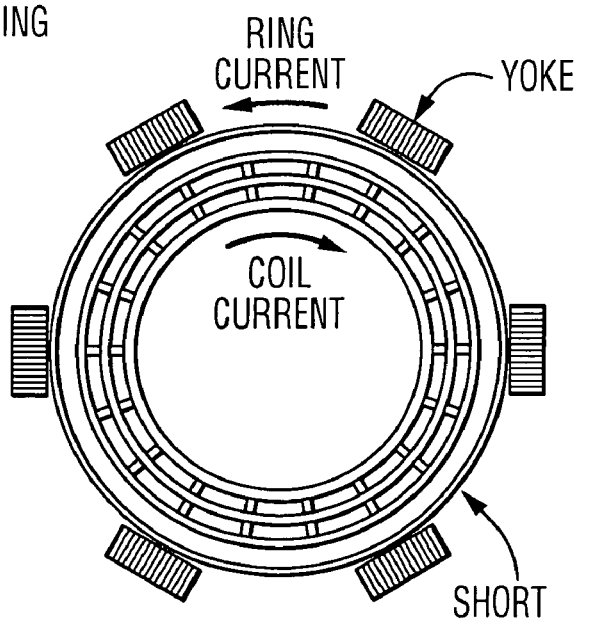
FIG. 1(c) (PRIOR ART)
Figure 2B:
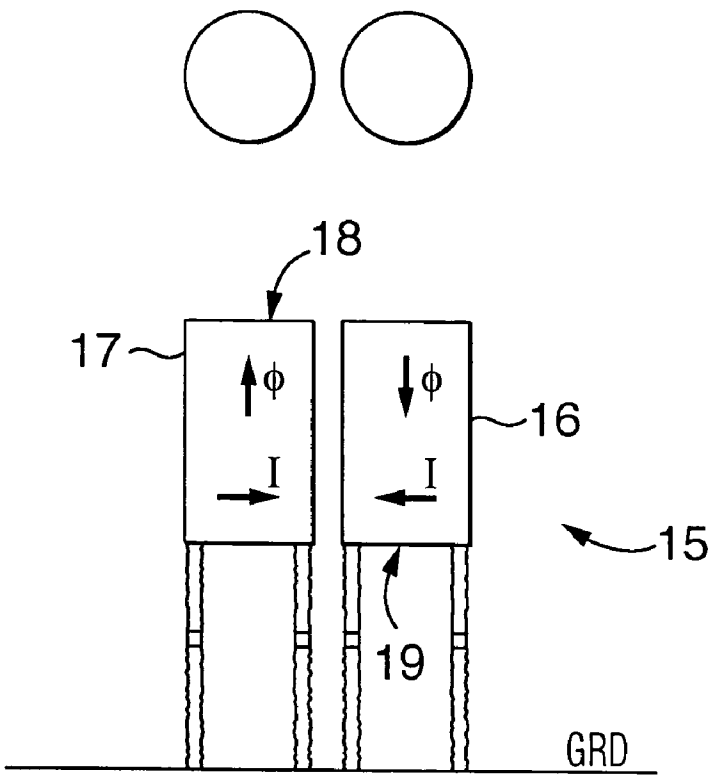
FIGS. 2(*a*) and 2(*b*) are elevational views and accompanying plan views illustrating a preferred method of the present invention using two reactors.
Figure 2A:
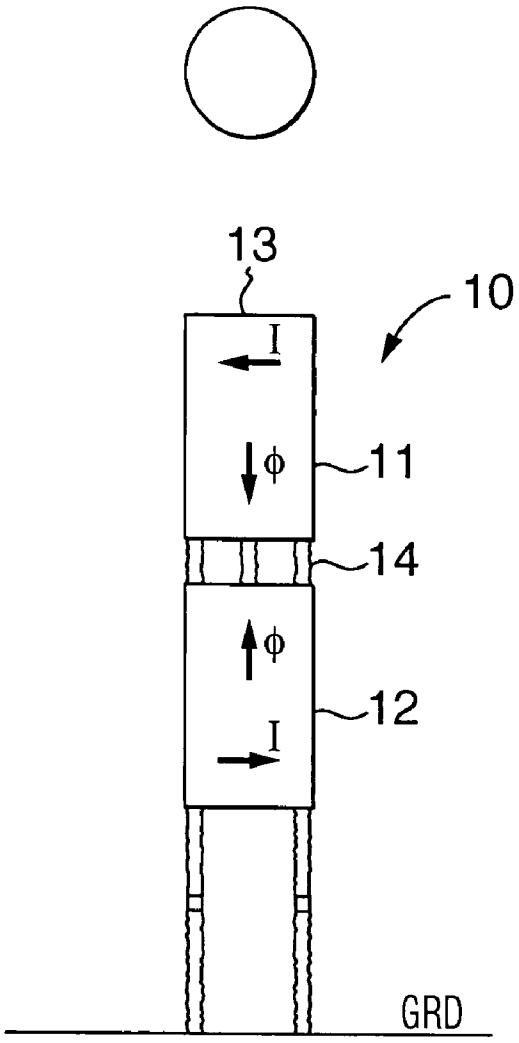
Figure 2D:
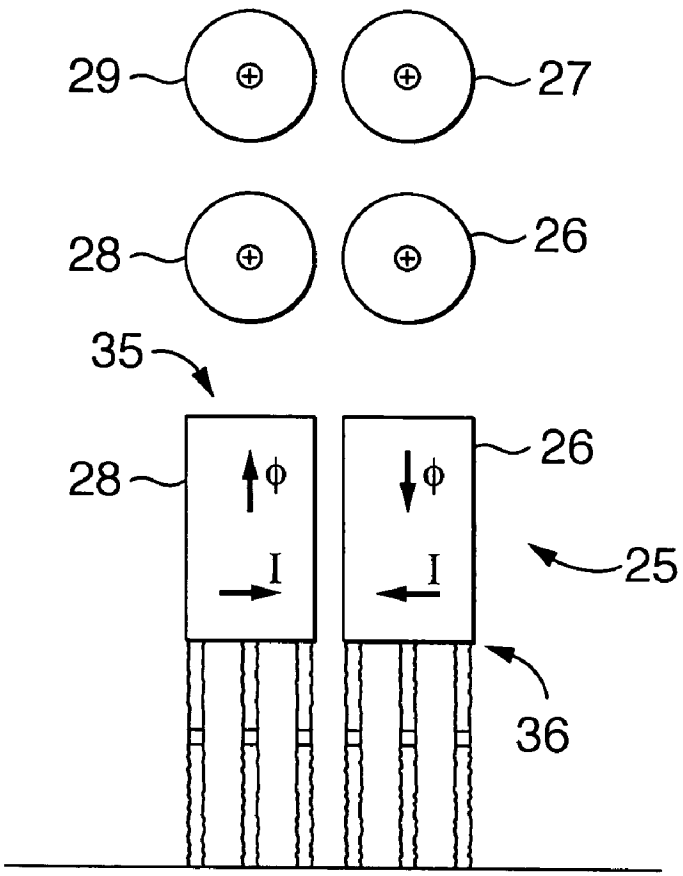
Figure 2C:
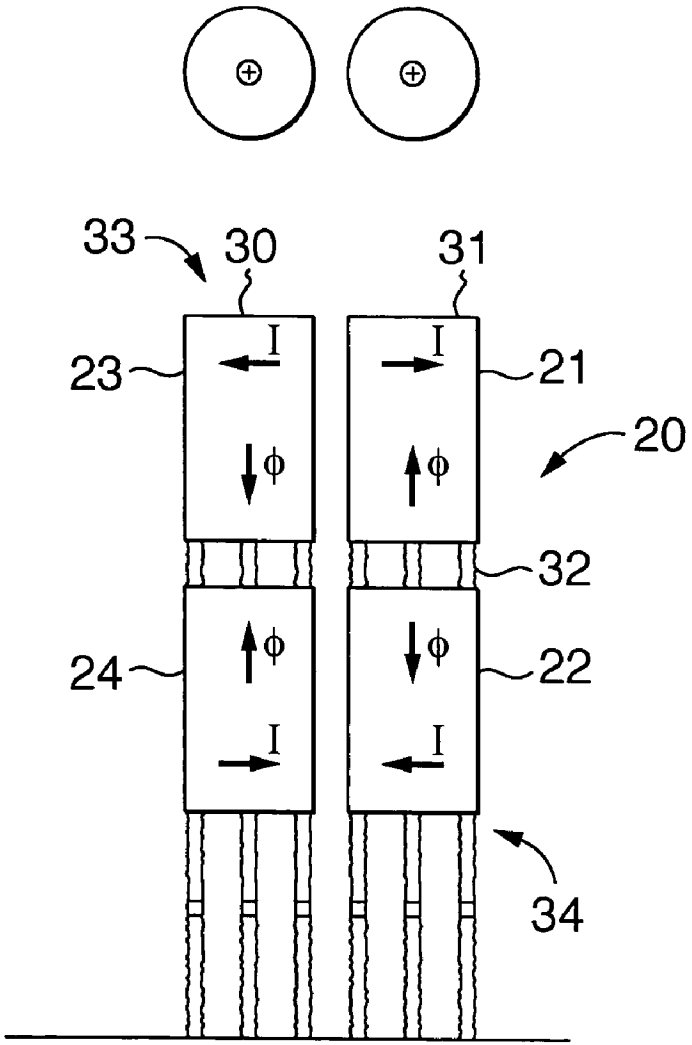

It is well known that standard installations of air core reactors generally employ a single coil per electrical phase. In some instances, where the electrical power rating is very large, multiple coils per phase may be employed whereby the coils would usually be configured to achieve the maximum positive coupling in order to reduce costs.

It follows that using multiple coil systems per phase in order to achieve magnetic field reduction over a large physical area has not been a technique previously used. In fact, the use of multiple coils per phase is usually not desirable since a single coil per phase system is always lower cost.

The present invention proposes that multiple coils per phase always be used when a substantial reduction in field strength is required in predetermined areas and configured geometrically and electrically in order to achieve the required reduction at lowest cost. Preferably, the coil multiples will be identical electrically but not necessarily mechanically due to mounting/installation considerations. The use of essentially identical coils is usually based on economic considerations although the use of coils of differing electrical power ratings can be used to achieve the magnetic field reduction.

EXEMPLARY EMBODIMENTS

A Quadrupole

According to a preferred embodiment of the invention, there is provided a method for controlling a magnetic field level that comprises the steps of connecting two reactors in an array with their dipole moments opposed so that the magnetic field of the array at distances large compared to the distance between the two reactor centers is that of a quadrupole and varies inversely as the fourth power of the distance; wherein the reactors' shapes, separation between said reactors and height above ground are chosen to meet a specified level of magnetic field at specified locations.

(i) A typical configuration of a quadrupole reactor array 10 is shown in FIG. 2(*a*) which comprises two electrically identical reactors 11 and 12 mounted one on top of the other thereby forming a column 13, although some mechanical differences may exist due to mounting requirements, said reactors 11 and 12 being electrically connected either in series or in parallel as long as the dipole moments of the two are of opposite sign.

For distances large compared to the distance between the reactor centers the magnetic field of the array (designated the far field) will decrease with distance as the fourth power of the distance from the array 10. For distances that are small compared to the distance between reactor centres, numerical solutions are used to accurately calculate the field.

The opposing of polarities produces a negative coupling that reduces the overall reactance of the array 10. This must be compensated for by increasing the selfinductances of the two reactors.

The array 10 is especially useful for highvoltage applications where the reactors are electrically connected in series at a midpoint 14 of the column 13. It should be understood that the reactors 11 and 12 can be electrically connected in parallel in order to achieve a higher current level if necessary.

(ii) Another configuration of a quadrupole array is illustrated in FIG. 2(*b*) which comprises two mechanically and electrically identical reactors 16 and 17 located side by side resulting in an array 15 electrically connected either in series or in parallel. As per the array 10, the reactors 16 and 17 are wound so that their dipole moments have opposite signs and the far field decreases with distance as the fourth power.

Unlike the series case illustrated in FIG. 2(*a*), the mutual coupling is positive and the overall reactance is greater than the sum of the two individual reactances. This must be compensated for by decreasing the sel-finductances of the two reactors.

The array 15 is well adapted to large current and moderate voltage level scenarios, in which case the two reactors 16 and 17 would be connected in parallel at top 18 and bottom 19. It follows that in such an arrangement there will be no voltage difference between the two reactors 16 and 17 and that they could physically be in contact if necessary. On the other hand, if the two reactors 16 and 17 were to be electrically connected in series there would be a voltage difference between them and a proper physical separation would have to be maintained.

According to another preferred embodiment of the invention, there is provided a method for controlling a magnetic field level, which comprises the steps of connecting two sets of quadrupole arrays of the type described in section A(i) above to form a new array such that their quadrupole moments are opposed and the magnetic field of the array at distances large compared to the distance between the two quadrupole centers will be that of an octopole and will vary inversely as the fifth power of the distance; wherein the reactors' shapes, separation between said reactors and height above ground are chosen to meet a specified rating of magnetic field at specified locations.

(i) A typical configuration of an octopole array is illustrated in FIG. 2(*c*). If this is compared to FIG. 2(*a*) it will be seen that the configuration of FIG. 2(*c*) comprises two quadrupole arrays 30, 31 along side each other. As illustrated in FIG. 2(*c*) the magnetic moments of the two quadrupole are of opposite polarities and the far field is that of an octopole. The far field of this array varies inversely as the fifth power of the distance from the array.

Reactors 21 and 22 comprise one quadrupole 31 and reactors 23 and 24 comprise the other 30. The two reactors in each stack would normally be connected in series at the center 32 of the stack so that there would be no voltage between them. However, they could be connected in parallel. Likewise the two stacks would normally be connected in parallel at the top 33 and bottom 34 of the stacks but could be connected otherwise provided that proper voltage clearances are observed.

(ii) Another configuration of an octopole array 25 is illustrated in FIG. 2(*d*). If this figure is compared to FIG. 2(*b*), it will be seen that FIG. 2(*d*) comprises two quadrupole 26, 28 along side each other and the quadrupole are of opposite polarity 26, 27, 28, and 29. The far field of the array is that of an octopole and the far field decreases as the fifth power of distance.

The simplest way of connecting the four reactors together would be to connect them in parallel at the top 35 and the bottom 36. This would be particularly appropriate if the current rating of the array were very large.

However, the only requirement to produce an octopole is for adjacent reactors to have opposite dipole moments.

In principle even higher order multipoles may be made. The next higher order multipole would be of order sixteen and would require two octopoles of opposite polarity, comprising an array of eight reactors, for example four stacks of two reactors. In general the far field of an array may be decreased by one order of magnitude by doubling the number of reactors and properly interconnecting them. Obviously, the construction of very high order multipole arrays becomes prohibitively expensive and most practical cases can be addressed by the quadrupole and octopole configurations. Therefore, a further method for controlling a magnetic field level may be comprised of the following steps of connecting $2^n$ reactors, where n is an integer, such that one half of them have dipole moments in the same direction and the other half have dipole moments in the opposite direction to form a multipole of order 2n, the far field of which varies with distance inversely as distance to the power (3+n); wherein the reactors' shapes, separation between said reactors and height above ground are chosen to meet a specified level of magnetic field at specified locations.

It will be understood by someone skilled in the art that the field in the immediate vicinity of the above arrays 10, 15, 20 and 25 may be increased significantly because of the close proximity of the reactors and that each arrangement has ramifications on losses and current distribution in parallel-wound reactors. The overall design of the array would have to take these ramifications into account in both the reactor designs and their arrangement.

The four exemplary embodiments provided in FIGS. 2(*a*), 2(*b*), 2(*c*) and 2(*d*) comprising electrically identical reactors all will result in decreasing the field significantly beyond the immediate vicinity. It should be noted that reactors of differing electrical power rating may be employed in order to control the location of specific magnetic field reduction although the use of identical reactors may result in the lowest cost.

ILLUSTRATIVE EXAMPLE

The following example is illustrative of the results to be obtained by using the method of the present invention. It compares the clearance distances required to meet a magnetic field value of less than 0.4 micro-tesla for three different reactor arrays, all of the same rating. The rating of each is single phase, 60 Hertz, 94.7 milli-Henry, 59 kV and 1650 Ampere. The reactors are all supported at an elevation of 25 feet above ground. The three reactor arrays are:

A) a dipole comprising a single reactor or a column of two reactors wound so that the magnetic coupling between them is positive;

B) a quadrupole comprising a column of two reactors electrically connected in series, wound so that the magnetic coupling between them is negative, as illustrated in FIG. 2(*a*);

C) an octapole comprising parallel sets of two columns of two reactors electrically connected in series, where all adjacent reactors are negatively coupled, as illustrated in FIG. 2(*c*).

Figure 3:
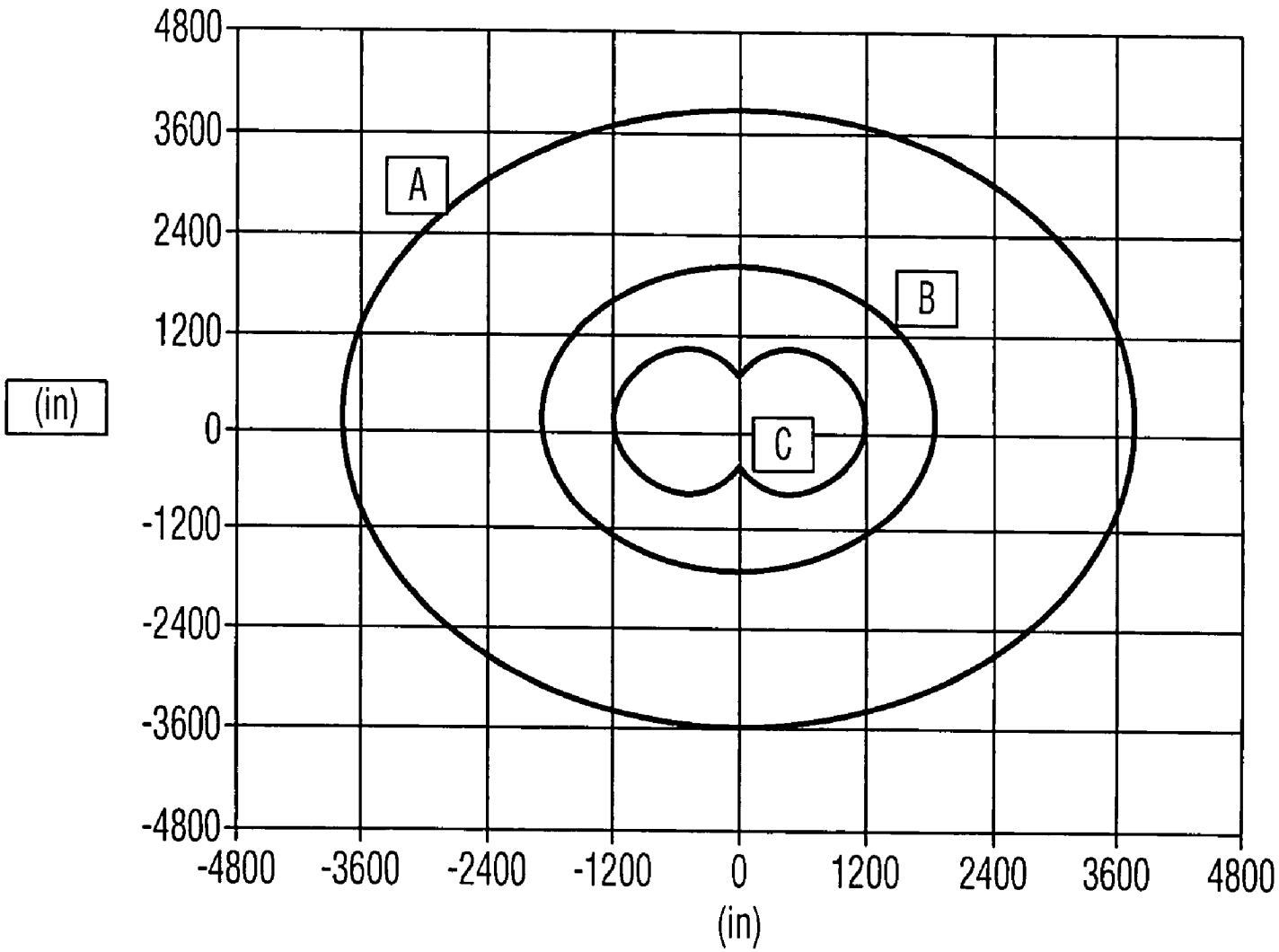
FIG. 3 is a graph illustrating magnetic field contours for three exemplary cases pursuant to the teachings of the present invention.

FIG. 3 illustrates the resulting magnetic field contours for the above three arrays at six feet above ground level beyond which the magnetic field is less than 0.4 micro-Tesla. It should be noted that the area required for the quadrupole array (B) is only 25% of that required for the dipole (A) and that the area required for the octapole array (C) is only 8% of that required for the dipole (A). The invention is not limited to the embodiments hereinbefore described, but may be varied within the scope of the claims in construction and detail.

We claim:

1. A method for controlling a magnetic field created by electric power distribution reactors, which comprises the steps of electrically connecting two electric power distribution reactors in series, parallel, or combination of series and parallel such that their dipole moments are opposed to form a quadrupole, the resulting far field of which varies inversely as the fourth power of the distance from the reactors.

2. A method according to claim 1 wherein the electric power distribution reactors are electrically connected in series.

3. A method according to claim 1 wherein the electric power distribution reactors are electrically identical.

4. A method according to claim 1 wherein the electric power distribution reactors are air-cored.

5. A method for controlling a magnetic field level, which comprises the steps of placing two power reactors one on top of the other and electrically connecting the power reactors in series at a mid-point resulting in no voltage difference at the connection point, such that the dipole moments of the power reactors are opposed to form a quadrupole, the resulting far field of which varies inversely as the fourth power of the distance from the reactors.

6. A method for controlling a magnetic field level, which comprises the steps of electrically connecting two cower reactors in parallel, such that their dipole moments are opposed to form a quadrupole, the resulting far field of which varies inversely as the fourth power of the distance from the reactors.

7. A method according to claim 6 wherein the reactors are placed alongside each other and electrically connected in parallel at top and bottom resulting in no voltage difference between adjacent points.

8. A method for controlling a magnetic field created by electronic power distribution reactors, which comprises the steps of electrically connecting two quadrupole arrays of electric power distribution reactors, which are configured such that their quadrupole moments are opposed in series, parallel, or a combination of series and parallel to form an octopole array, the resulting far field of which varies inversely as the fifth power of the distance from the array.

9. A method according to claim 8 wherein the quadrupole arrays each comprise two electric power distribution reactors electrically connected in series and mounted alongside each other in two rows of two reactors each to form an octopole.

10. A method according to claim 8 wherein the reactors are electrically identical.

11. A method according to claim 8 wherein the reactors are air-cored.

12. A method for controlling a magnetic field level, which comprises the steps of electrically connecting two quadrupole arrays of power reactors, which are configured such that their quadrupole moments are opposed in series, parallel, or a combination of series and parallel to form an octopole array, the resulting far field of which varies inversely as the fifth power of the distance from the array wherein the quadrupole arrays each comprise two reactors electrically connected in series at a mid-point resulting in no voltage difference at the connection point and are mounted alongside each other in two rows of two reactors each to form an octopole.

13. A method for controlling a magnetic field level, which comprises the steps of electrically connecting two quadrupole arrays of power reactors, which are configured such that their quadrupole moments are opposed in series, parallel, or a combination of series and parallel to form an octopole array, the resulting far field of which varies inversely as the fifth power of the distance from the array wherein the quadrupole arrays each comprise two reactors electrically connected in parallel that are mounted alongside each other in two rows of two reactors each to form an octopole.

14. A method for controlling a magnetic field level, which comprises the steps of electrically connecting two quadrupole arrays of power reactors, which are configured such that their quadrupole moments are opposed in series, parallel, or a combination of series and parallel to form an octopole array, the resulting far field of which varies inversely as the fifth power of the distance from the array wherein the quadrupole arrays each comprise two reactors electrically connected in parallel at top and bottom resulting in no voltage difference between adjacent points and are mounted alongside each other in two rows of two reactors each to form an octopole.

15. A method for controlling a magnetic field level, which comprises the steps of connecting $2^n$ electric power distribution reactors, where n is an integer, such that one half of them have dipole moments in the same direction and the other half have dipole moments in the opposite direction to form a multipole of order 2n, the far field of which varies with distance inversely as distance to the power (3+n).

16. A method according to claim 15 wherein the reactors are electrically identical.

17. A method according to claim 15 wherein the reactors are air-cored.

18. A method for controlling a magnetic field level, which comprises the steps of electrically connecting two power reactors in series, parallel, or combination of series and parallel such that their dipole moments are opposed to form a quadrupole, the resulting far field of which varies inversely as the fourth power of the distance from the reactors where the two reactors may be connected in any manner consistent with voltage isolation requirements as long as a quadrupole is produced.

19. A method for controlling a magnetic field level, which comprises the steps of electrically connecting two quadrupole arrays of power reactors, which are configured such that their quadrupole moments are opposed in series, parallel, or a combination of series and parallel to form an octopole array, the resulting far field of which varies inversely as the fifth power of the distance from the array where the four reactors may be connected in any manner consistent with voltage isolation requirements as long as an octopole is produced.

* * * * *

UNITED STATES PATENT AND TRADEMARK OFFICE

CERTIFICATE OF CORRECTION

PATENT NO. : 7,061,741 B2
APPLICATION NO. : 10/389107
DATED : June 13, 2006
INVENTOR(S) : Patrick Earl Burke et al.

It is certified that error appears in the above-identified patent and that said Letters Patent is hereby corrected as shown below:

Column 6, line 64
Delete “level”

Column 7, line 5
Delete “level”

Column 7, line 6
Replace “cower”
With -- power --

Column 7, line 16
Replace “electronic”
With -- electric --

Column 7, line 32
Delete “level”

Column 7, line 44
Delete “level”

Column 8, line 5
Delete “level”

Column 8, line 17
Delete “level”

Column 8, line 29
Delete “level”

UNITED STATES PATENT AND TRADEMARK OFFICE

CERTIFICATE OF CORRECTION

PATENT NO. : 7,061,741 B2
APPLICATION NO. : 10/389107
DATED : June 13, 2006
INVENTOR(S) : Patrick Earl Burke et al.

It is certified that error appears in the above-identified patent and that said Letters Patent is hereby corrected as shown below:

Column 8, line 38
Delete "level"

Signed and Sealed this

Thirtieth Day of January, 2007

JON W. DUDAS
*Director of the United States Patent and Trademark Office*